United States Patent [19]

Norton

[11] 4,434,981

[45] Mar. 6, 1984

[54] CROSS COUNTRY SKIING SIMULATING EXERCISER

[76] Inventor: Desmond H. Norton, 1122 Patterson St., Ogden, Utah 84403

[21] Appl. No.: 320,837

[22] Filed: Nov. 12, 1981

[51] Int. Cl.[3] ..... A63B 69/18

[52] U.S. Cl. ..... 272/97; 272/70

[58] Field of Search ..... 272/97, 70, 70.3, 70.4; 128/25 R, 25 B; 434/253, 255

[56] References Cited

U.S. PATENT DOCUMENTS

| | | | |
|---|---|---|---|
| 2,900,008 | 8/1959 | Seger | 434/255 X |
| 3,582,069 | 6/1971 | Flick et al. | 272/70 X |

FOREIGN PATENT DOCUMENTS

| | | | |
|---|---|---|---|
| 2411365 | 9/1975 | Fed. Rep. of Germany | 272/70 |
| 2631897 | 1/1978 | Fed. Rep. of Germany | 272/97 |
| 2007987 | 5/1979 | United Kingdom | 272/70 |

*Primary Examiner*—William H. Grieb

*Attorney, Agent, or Firm*—A. Ray Osburn

[57] ABSTRACT

An exercising apparatus adapted to simulate cross country skiing, comprising a pair of foot carrying platforms guided and constrained to roll in parallel, opposed reciprocatory motions. Simulated ski poles are guided at their bottom ends for back and forth strokes parallel to the foot platforms, resisted backwardly by elastic restraining cords. According to one aspect of the invention, a standard four legged walking aid may be utilized instead of the ski poles, for use of the apparatus by the infirm.

14 Claims, 12 Drawing Figures

CROSS COUNTRY SKIING SIMULATING EXERCISER

BACKGROUND OF THE INVENTION

1. Field

The invention is within the broad field of exercise devices which simulate physical activities such as swimming, walking or running, and more particularly such machines which simulate the bodily motions of cross country skiing.

2. Prior Art

In cross country skiing, the legs move reciprocally forward and backward with respect to the body oppositely to each other. Backward leg motions provide the forward propulsive force, while forward leg motions place the associated skis into position for the next backward leg motion. A pair of ski poles, powered by arm, shoulder, back and chest muscles, provides additional forward thrust. The ski poles may be used in reciprocating motions similar to that of the skis or in simultaneous rearward thrusting motions followed by simultaneous forward movement of the poles to obtain purchase for the next rearward thrust. While a great number of machines have been devised to simulate downhill skiing, few have dealt with cross country skiing. U.S. Pat. No. 3,941,377 discloses a device with simulated ski segments 39 and 40 each provided with an underlying endless flexible belt tread allowing the skier to stride against frictional resistance provided to backward movement of the belt treads. The skis act against separate belts also frictionally restrained against rearward motion. The user therefore tends to move forward off the apparatus, restrained however by forward stops for the ski segments against which the skier must act. In U.S. Pat. No. 4,023,795, frictional resistance to backward ski motions are provided by friction wheels 21. In this design, an upright waist high pedestal must be provided in front of the skier, against which he is pressed during exercise to restrain him from moving fowardly off the device. Simulated ski poles are provided having a ground engaging frictionally attached disc to simulate resistance of ski pole strokes. The ski pole forward forces on the skier also press the skier against the restraining pedestal. The problem of restraining the skier is always attendant to devices employing such frictional restraint, and generally leads to undesirable complexity in the device. Also, body stops are unnatural and generally reduce the enjoyment in use of these devices.

Another friction utilizing device is disclosed in U.S. Pat. No. 4,023,795. Guided foot dollies are disclosed in U.S. Pat. Nos. 3,559,986 and 1,909,190. No connection between dollies is provided in U.S. Pat. No. 3,559,986, the skier being protected for excessively long, hard to control, foot separations only by end stops. It is complicated by pivotable foot contacting portions of the dollies. Guided dollies connected for reciprocatory parallel movement are disclosed in U.S. Pat. No. 1,909,190. These exercisers avoid some of the aforesaid disadvantages of the friction devices, but are not adapted for skiing simulation, having no simulated ski poles. While the arms and upper body are exercised considerably, many muscles used in cross country skiing remain unused. Further, they are not adapted for use by the infirm, considerable athletic ability, especially balancing capability, being needed in the absence of the poles or other graspable body support provision. The devices requiring lifting and setting down of the feet introduce impact shock into ankle and knee joints similarly to jogging, which may preclude their use by people with arthritis or other joint weaknesses.

BRIEF SUMMARY OF THE INVENTION

With the foregoing in mind, the disadvantages of prior art cross country skiing simulating exerciser devices are eliminated or substantially alleviated by the present invention, which comprises a pair of foot platforms each adapted for reciprocating guided motion upon a horizontal base member, the platforms being connected together, preferably by flexible cable and pulley means, so that the motions of the pair must always be oppositely directed. Since the feet always remain upon the platforms, impact shock to ankle and knee joints is largely eliminated. A pair of simulated ski poles is provided, each guided at their lower ends to move back and forth generally parallel to the direction of motion of the foot platforms. Preferably, the rearward motions of each ski are restrained to simulate ski pole force. Preferably, the ski pole restraining means comprises a tensionable elastic band secured at one end to the forward portion of the base member and at the other at selectable locations along the ski pole, so that the magnitude of ski pole restraining force may be selected to suit the individual. Preferably, the cable and pulley provisions are mounted below the base member, which is raised upon supporting members to provide the necessary clearance, the platforms then being guided by downstanding guide members engaging elongate slots vertically through the base. The cables are attached to the guide members below the horizontal base members. According to one aspect of the invention, stationary elevated graspable support means are provided, instead of ski poles, for infirm or less venturesome users. Such supports may be secured upstanding from the base, or may be separately supported upon the floor. For example, a standard four legged walking aid can be utilized.

It is therefore a principal object of the invention to provide an apparatus for exercising the legs and lower body in a manner similar to cross country skiing, and without the jarring impact associated with actual skiing, jogging, or the use of other exercising apparatus, such as treadmills and frictionally resisted tread machines. Further objects include providing means for exercising the arms and upper body with skiing-like motions, and also providing an exerciser which can be used by less athletic persons.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figures 1, 2, 3:
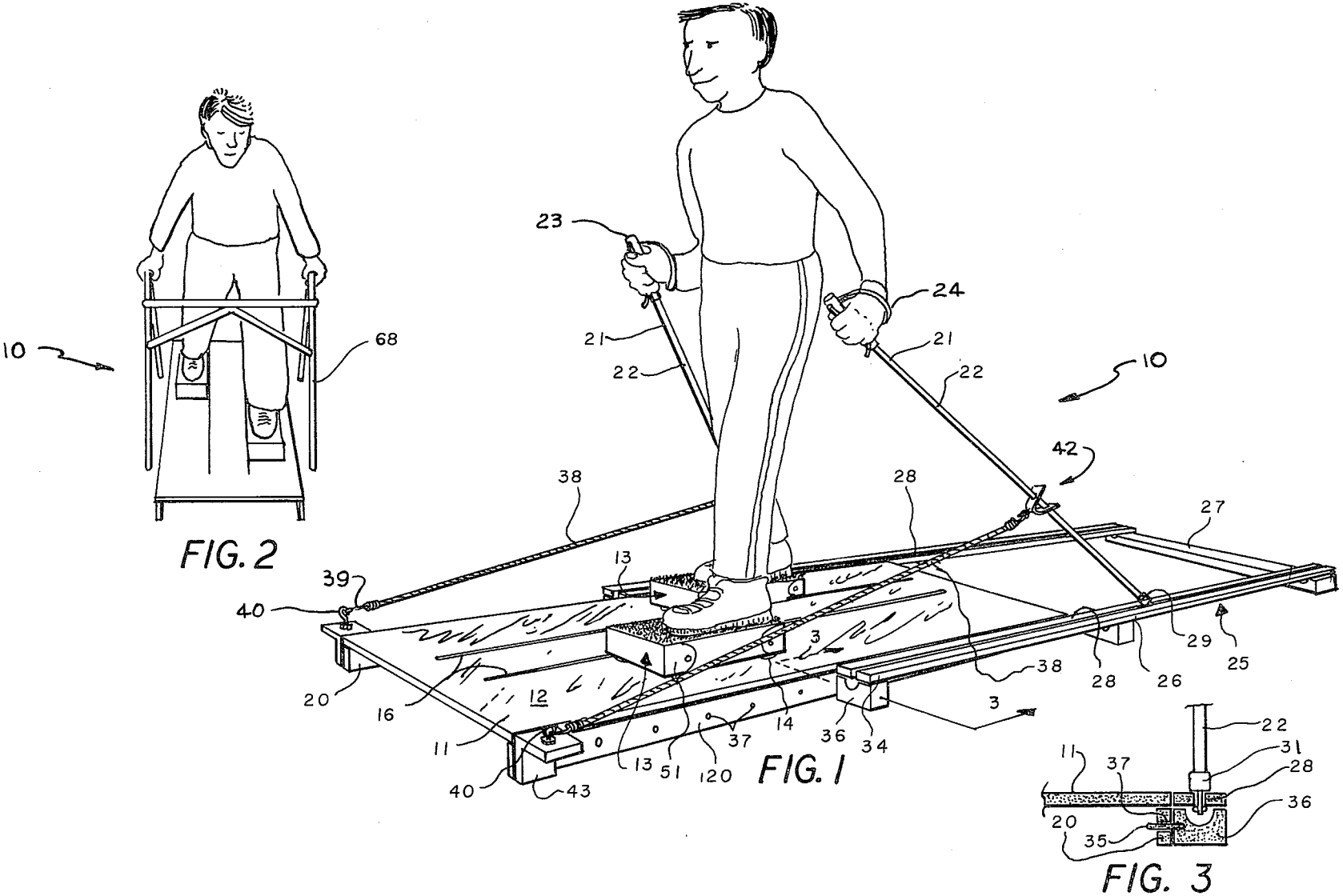
FIG. 1 is a perspective drawing showing the invention being used in the cross country ski simulating manner, FIG. 2 a perspective drawing showing the invention in use with a separate graspable support for the infirm or less venturesome user, FIG. 3 a vertical cross section of a fragment of the exerciser of FIG. 1, taken along line 3—3 thereof, drawn to a larger scale, FIG. 4 a plan view of the exerciser of FIG. 1, including a fragment of the ski pole guiding attachment, drawn generally to the scale of FIG. 1, FIG. 5 a vertical cross sectional view of a fragment of the exerciser of FIG. 4, taken along line 5—5 thereof, drawn to an enlarged scale, FIG. 6 a bottom plan view of the exerciser of FIG. 4, drawn to the same scale, FIG. 7 an enlarged view of a fragment of the exerciser, taken at area 7 of FIG. 8, the cable attachment sleeve thereof being shown in vertical section, FIG. 8 a vertical cross sectional view of a fragment of the exerciser of FIG. 4, taken along stepped line 8 thereof, drawn to a somewhat larger scale, FIG. 9 a bottom plan view of one of the foot platforms of FIG. 4, drawn to the scale of FIG. 8, FIG. 10 a fragmented elevation view of one of the simulated ski poles of FIG. 1, including an end fragment of the attaching elastic cable of FIG. 1, FIG. 11 an elevation view of a fragment of the ski pole of FIG. 10, showing the spring clip cable attachment provisions thereof, drawn to an enlarged scale, and FIG. 12 an elevation drawing of a lower end fragment of the pole of FIG. 10, drawn to the scale of FIG. 11.
Figure 4:
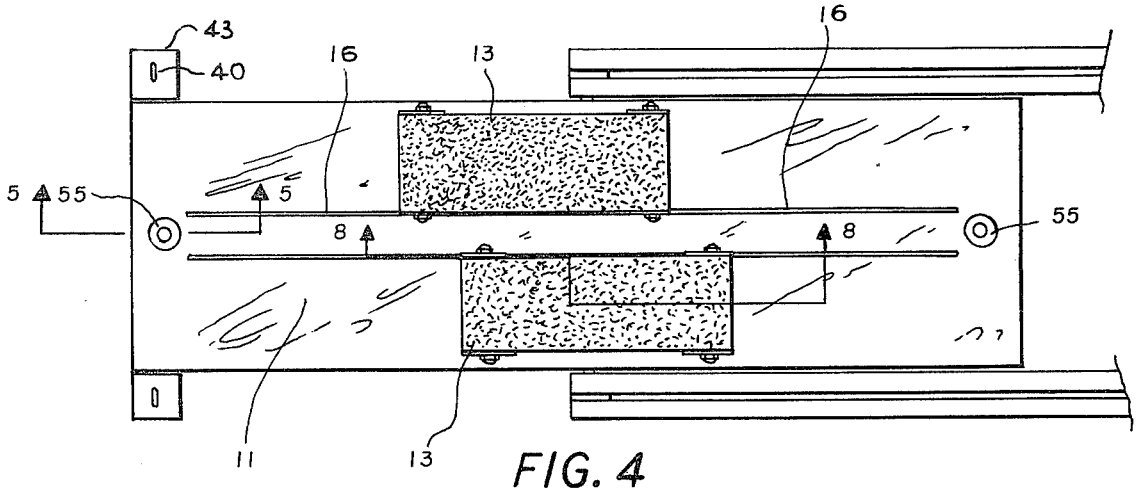
Figure 8:
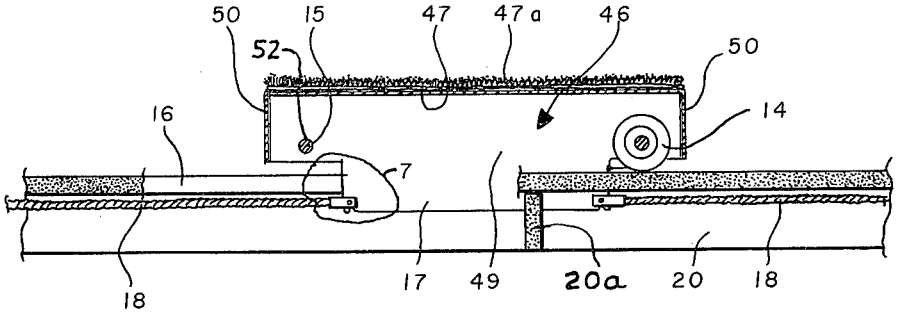
Figure 9:
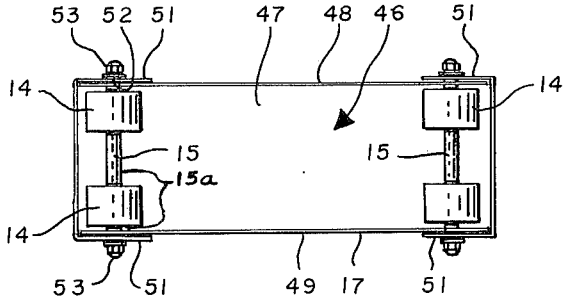

The illustrated cross country skiing simulator and exerciser 10 comprises a generally flat base member 11, having an upper surface 12, adapted to support a pair of parallel foot platforms 13 simulating a pair of cross country skis. (FIG. 1) Each platform 13 has two pairs of rollers 14, each arranged upon transverse axles 15 to permit ski-like forward and rearward motion of the foot platform upon surface 12. (FIGS. 8 and 9) The platforms 13 are restrained from transverse slipping or wandering as by parallel guide slots 16 longitudinal to and through base 11, through which extend elongate guide plates 17 downstanding from each ski platform. Platforms 13 are secured together by flexible cables 18, connecting guide plates 17 and engaging horizontal pulleys 19 beneath base plate 11. (FIGS. 6–9) Longitudinal base runners 20 and central cross support **20*a*, notched to clear cables and guide plates, elevate base member 11 to provide clearance for cables 18 and pulleys 19. Foot platforms 13 are thus guided and restrained into parallel reciprocal back and forth motion along slots 16**, providing foot and leg motions similar to those of cross country skiing.

Figure 11:
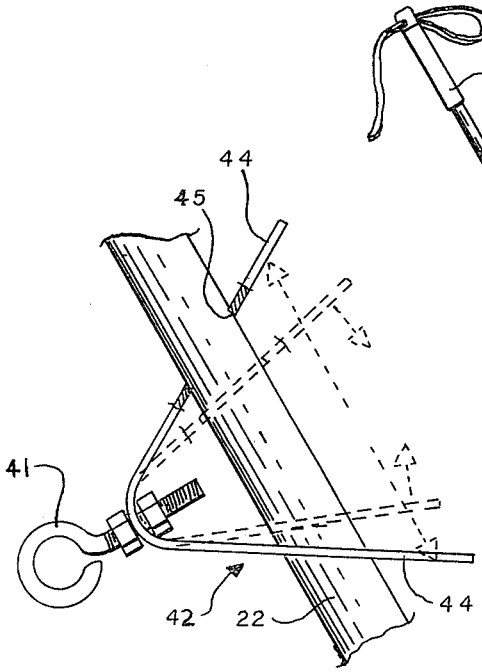
Figure 10:
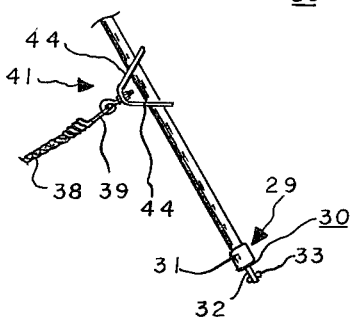
Figure 12:
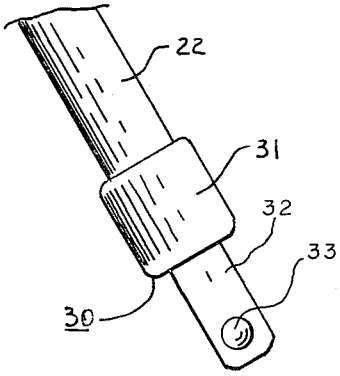

Skiing simulator 10 preferably comprises also a pair of simulated ski poles 21, to permit simulation of the arm and shoulder movements of cross country skiing. (FIGS. 1, 10–12) Each pole 21 has a shaft 22, hand grip 23 and an adjustable wrist strap 24. A pole guiding attachment 25 to base 11 has elongate side members 26 and a rear cross member 27. Pole guiding slots 28 are provided in members 26, generally parallel to the platform guide slots 16. Lower ends 29 of poles 21 comprise rounded sliding surfaces 30 upon pole end caps 31, and guide slot engaging tabs 32 extending downwardly therefrom. Preferably, each tab 32 carries means for its retention in slot 28, such as cross pin 33. To permit engagement and removal of poles 21, each pole guide slot 28 extends to forward end 34 of its associated side member 26. (FIGS. 1 and 3) Pole guide attachment 25 may be secured to base 11 as by dowel pins 35 extending from blocks 36 to base member runners 20 at selectable locations through bores 37. Ski poles 21 may if desired be unrestrained against back and forth motions, with bottom ends 29 guided by tab extensions 32 in slots 28. Such use provides considerable coordinated practice of the arms and torso. However, for greater realism, pole restraining elastic cords 38 are preferably provided. (FIGS. 1, 10–11) End hooks 39 of each elastic cord 38 engage a forward eyebolt 40 at the forward end of base member 11, and also eyebolt 41 of a pole shaft engaging clip assembly 42. Forward eyebolts 40 are preferably in line with pole guide slots 28, eyebolt mounting blocks 43 being secured outstanding from base member runners 20. Clip 42 is secured releasably along shaft 22 of ski pole 21. Diverging clip spring arms 44 have aligned elongate, sharp edged perforations 45, the edges of which engage the outer surface of shaft 22 to hold clip 42 in selected locations. When clip arms 44 are manually pressed toward each other, clip 42 is freely movable along shaft 22. (FIGS. 10 and 11) Securement of clips 42 lower on shaft 22 produces increased tension in elastic cords 38, with increased resistance to pole motion. In this manner, the resistance to ski pole motion may be adjusted to suit the individual.

Foot platforms 13 may advantageously comprise inverted sheet metal boxes 46, each having a top 47, side walls 48 and 49, and end walls 50. (FIGS. 1, 8 and 9) Advantageously, side walls 49 are extended downward below boxes 46 to provide the aforementioned guide plate 17. Box 46 may be formed of a single sheet metal blank, including also ear portions 51, for subsequent forming into box corners. Transverse bores 52 through ears 51 and sidewalls 48 and 49 receive axles 15, with end nuts 53, securing ends and sides 48, 49 and 50 into rigid boxes 46. Each axles 15 carries a pair of the roller wheels 14, each in clearing proximity to one of the side walls 48 and 49. Wheels 14 are equipped with a pair of internal ball bearing assemblies, not shown, to assure long wheel life and quiet operation. Standard plastic roller skate wheel assemblies may be advantageously employed. Axles 15 with wheel spacing sleeves **15*a*, engage internal races within each wheel bearing. The tops 47 of foot boxes 46 are advantageously covered with a slip resisting padding 47*a***, such as urethane backed carpeting secured thereto as by gluing.

Figure 5:
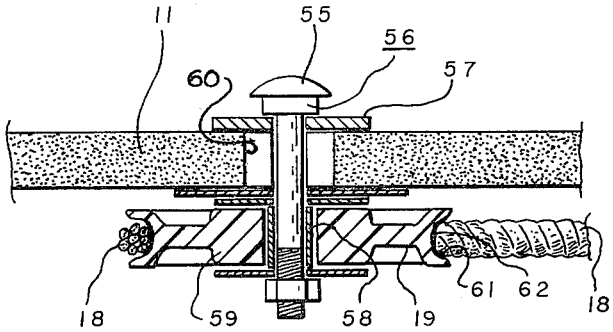
Figure 7:
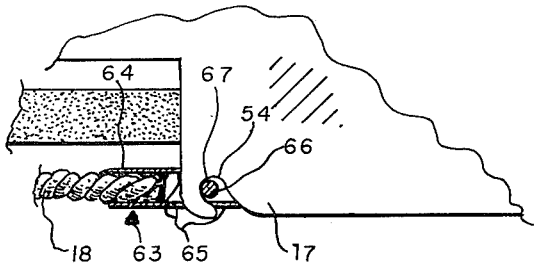
Figure 6:
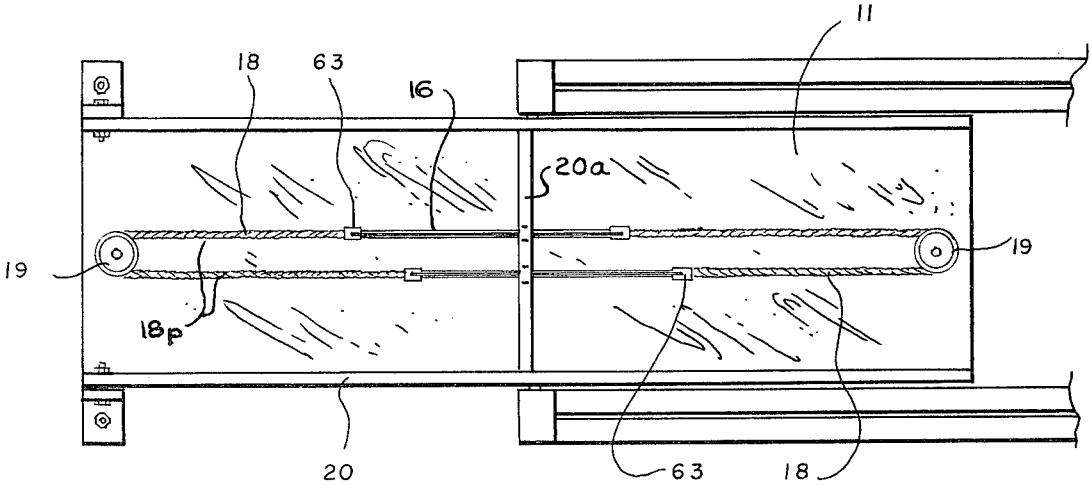

Each guide plate 17 has a notched bore 54 near each of its downward corners for easy attachment, and release, of platform connecting cables 18. Each cable 18 is guided around an associated one of the pulleys 19. (FIGS. 5–7) To prevent guide plates 17 from being pulled against the sides of platform guide slots 16, pulleys 19 are sized so that cable portions **18*p* are substantially parallel and each in line with one of the guide slots 16. Each pulley is secured to base member 11 rotatably as by a shoulder bolt 55, which provides wrenching surfaces 56 above an upper washer 57. Pulleys 19 turn about a bushing 58 slightly longer than the thickness of pulley hub 59. Pulley bolt 55 may thus be firmly tightened immovably against the ends of bushing 58, with pulley 19 remaining freely rotatable. Pulley mounting bores 60 are preferably elongated longitudinally to base member 11 so that cables 18 may be tensioned. Cables 18 are preferably of flexible, substantially inelastic plastic rope, such as ¼" "Polypro." Other materials may be used, including hemp rope or even flexible steel cable. However, plastic rope provides practically unlimited resistance to bending fatigue, and is soft enough to permit use of plastic or wood pulleys 19 with very little wear. The combination of plastic rope cables 18, plastic pulleys 19, roller skate wheels 14, and base member 11 of pressed wood has proven to produce an exerciser 10** both durable and desirably quiet in operation. Preferably, cable grooves 61 in pulleys 19 have circular roots 62, to provide uniform bearing upon cables 18 to resist cable wedging or loosening. Each end of each cable 18 has a preferably metallic guide attachment assembly 63. (FIG. 7) Sleeve 64 is bonded through a portion of its inside surface to the end of cable 18. A longitudinal slot 65 is of proper width to loosely accept the thickness of guide plate 17 of box 46. A cross pin 66, frictionally secured in a pin bore 67, engages notched bore 54 of guide plate 17 and is easily released therefrom.

Exerciser 10 may be advantageously employed by the infirm, or those with impaired balance, in which case ski pole guide attachment 25 is removed from base 11. A walking aid 68 may advantageously be used to support such infirm users against falls from weakness or failure of balance, so that he may exercise with confident vigor within his physical capabilities. (FIG. 2) Or, support means, not shown, may be secured upstanding from base 11. Used in this manner, exerciser 10 may be quite effective in regaining impaired walking and balancing capabilities, and for strengthening legs, arms, chest and back muscles.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. An exercising apparatus adapted to simulate cross country skiing, comprising:

a base member, the upwardly facing surface thereof being generally planar;

a pair of foot supporting platforms each having rolling means for support thereof upon the upward facing surface of the base member;

means for guiding each of the foot platforms along generally parallel paths upon said surface;

means for restraining the foot platforms to oppositely directed reciprocatory movements;

a pair of simulated ski pole means;

means for guiding the lowermost end of each pole in reciprocatory motion generally parallel to the motion of the foot platforms; and means for yieldably resisting motion of each one of the pair of poles directed backwardly with respect to the user of the apparatus, said means being functionally independent of the motions of the foot platforms.

2. An exercising apparatus adapted to simulate cross country skiing, comprising:

a base member, the upwardly facing surface thereof being generally planar;

a pair of foot supporting platforms each having rolling means for support thereof upon the upward facing surface of the base member;

means for guiding each of the foot platforms along generally parallel paths upon said surface;

means for restraining the foot platforms to oppositely directed reciprocatory movements;

a pair of simulated ski pole means;

means for guiding the lowermost end of each pole in reciprocatory motion generally parallel to the motion of the foot platforms;

means for yieldably resisting motion of each one of the pair of poles directed backwardly with respect to the user of the apparatus; wherein the pole guiding means comprises a pair of horizontal slot means in the base member, and means carried upon the lowermost ends of the poles for slideable engagement of said slot means.

3. The apparatus of claim 2, wherein:

the pole motion resisting means comprises a pair of elongate elastic tensionable members each adapted to be secured at its opposite ends to the base and one of the poles respectively.

4. The apparatus of claim 3, wherein:

each pole includes means for securing the associated elastic member in selectable locations therealong.

5. The apparatus of claim 4, wherein:

the elastic member securing means comprises manually releasable spring clip means manually slideable along the pole when released.

6. The apparatus of claim 5, wherein:

the pole guiding slot means are open ended, and the pole slot engaging means includes means preventing upward removal of the pole from the slot means.

7. An exercising apparatus adapted to simulate cross country skiing, comprising:

a base member, the upwardly facing surface thereof being generally planar;

a pair of foot supporting platforms each having wheel means for rolling support thereof upon the upwardly facing surface;

a pair of elongate slot means in the base member for guiding the foot platforms in generally parallel paths upon said surface;

slot engaging guide means downstanding from the foot platforms;

means for restraining the foot platforms to oppositely directed reciprocatory movements, wherein:

the foot platform motion restraining means comprises flexible cable and pulley means;

wherein the cable and pulley means comprises cable means connecting the foot platforms together and running both forwardly and rearwardly from each, and pulley means mounted on the base member directing the forwardly and rearwardly running cable means into generally parallel relationship to the platform guiding slots in the base member, said cable means comprising a forward cable connected at its ends to each foot platform forwardly thereon, and a rearward cable connected at its ends to each foot platform rearwardly thereon and the pulley means comprises a forward and a rearward pulley each mounted upon the base member forwardly and rearwardly respectively of the platforms;

a pair of simulated ski pole means; and slot means in the base member for guiding the lowermost end of each pole in reciprocatory motion generally parallel to the motion of the foot platforms.

8. The apparatus of claim 7, further comprising:

elongate elastic means for yieldably resisting motion of each one of the pair of poles directed backwardly with respect to the user of the apparatus.

9. The apparatus of claim 8, wherein:

the elongate elastic means are each adapted to be secured at one end forwardly upon the base member, and at the other end at selectable locations along the associated ski pole.

10. An exercising apparatus adapted to simulate cross country skiing, comprising:

a base member, the upwardly facing surface thereof being generally planar;

a pair of foot supporting platforms each having wheel means for rolling support thereof upon the upwardly facing surface;

a pair of elongate slot means in the base member for guiding the foot platforms in generally parallel paths upon said surface;

slot engaging guide means downstanding from the foot platforms;

means for restraining the foot platforms to oppositely directed reciprocatory movements, wherein;

the foot platform motion restraining means comprises flexible cable and pulley means;

wherein the cable and pulley means comprises cable means connecting the foot platforms together and running both forwardly and rearwardly from each, and pulley means mounted on the base member directing the forwardly and rearwardly running cable means into generally parallel relationship to the platform guiding slots in the base member, said cable means comprising;

a forward cable connected at its ends to each foot platform forwardly thereon, and a rearward cable connected at its ends to each foot platform rearwardly thereon;

the pulley means comprises a forward and a rearward pulley each mounted upon the base member forwardly and rearwardly respectively of the platforms; wherein each platform guiding slot means extends vertically through the base member, the slot engaging members extend from the platform downwardly through said guide slots, the cable means are connected to the slot engaging members below the base member, and the pulleys are mounted downstanding from the base member and the exerciser further comprises support means downstanding from the base member providing vertical clearance in which the cable and pulley means may freely operate; said apparatus further comprising a pair of simulated ski poles means; and slot means in the base member for guiding the lowermost end of each pole in reciprocatory motion generally parallel to the motion of the foot platforms.

11. The apparatus of claim 10, further comprising:

elongate elastic means for yieldably resisting motion of each one of the pair of poles directed backwardly with respect to the user of the apparatus.

12. The apparatus of claim 11, wherein:

the elongate elastic means are each adapted to be secured at one end forwardly upon the base member, and at the other end at selectable locations along the associated ski pole.

13. The apparatus of claim 12, wherein:

the elastic member securing means comprises manually releasable spring clip means manually slideable along the pole when released.

14. The apparatus of claim 13, wherein:

the pole guiding slot means are opened ended, and the pole slot engaging means includes means preventing upward removal of the pole from the slot means.

* * * * *